US006813847B2

(12) United States Patent
Workman

(10) Patent No.: US 6,813,847 B2
(45) Date of Patent: Nov. 9, 2004

(54) BOOT WITH REPLACEABLE SOLE PLATE

(76) Inventor: Robert Workman, 9333 SE. Alansa Blvd., Clackamas, OR (US) 97015

( * ) Notice: Subject to any disclaimer, the term of this patent is extended or adjusted under 35 U.S.C. 154(b) by 19 days.

(21) Appl. No.: 10/293,188

(22) Filed: Nov. 12, 2002

(65) Prior Publication Data

US 2004/0088883 A1 May 13, 2004

(51) Int. Cl.[7] ..... A43C 13/00; A43B 3/25
(52) U.S. Cl. ..... 36/15; 36/100
(58) Field of Search ..... 36/15, 100, 101

(56) References Cited

U.S. PATENT DOCUMENTS 1,542,174 A * 6/1925 Robidoux ..... 36/15
2,640,283 A * 6/1953 McCord ..... 36/25 R
3,538,628 A 11/1970 Einstein, Jr.
3,866,339 A 2/1975 Latto
3,902,259 A * 9/1975 Cracco ..... 36/11.5
4,279,083 A 7/1981 Dilg
4,317,294 A * 3/1982 Goodyear ..... 36/100
4,377,042 A 3/1983 Bauer
4,745,693 A 5/1988 Brown
5,317,822 A 6/1994 Johnson
5,410,821 A * 5/1995 Hilgendorf ..... 36/100
5,533,280 A * 7/1996 Halliday ..... 36/101
5,644,857 A * 7/1997 Ouellette et al. ..... 36/15
5,657,558 A * 8/1997 Pohu ..... 36/131
5,661,915 A 9/1997 Smith
5,692,322 A * 12/1997 Lombardino ..... 36/100
5,761,833 A * 6/1998 McMullin ..... 36/67 D
5,956,870 A * 9/1999 Grossman et al. ..... 36/127
5,996,252 A 12/1999 Cougar
6,345,454 B1 * 2/2002 Cotton ..... 36/101
6,481,121 B1 * 11/2002 Tucker ..... 36/62

FOREIGN PATENT DOCUMENTS

EP 0153136 2/1985
JP 211901 1/1993

* cited by examiner

*Primary Examiner*—Marie Patterson
(74) *Attorney, Agent, or Firm*—Chernoff, Vilhauer, McClung & Stenzel, LLP

(57) ABSTRACT

A boot has a cavity located in the bottom of the sole and a sole plate that releasably fits within this cavity. A tab located on the toe end of the sole piece fits into a slot located in the sidewall of the cavity to hold the toe end of the sole plate in the cavity. A strap is attached to the heel end of the sole plate and extends to an attachment device located on the back of the boot. The attachment device places the strap in tension to hold the heel end of the sole plate in the cavity.

8 Claims, 4 Drawing Sheets

BOOT WITH REPLACEABLE SOLE PLATE

BACKGROUND AND SUMMARY OF THE INVENTION

This invention relates to a boot having a sole plate that can easily and quickly be replaced with other sole plates having different types of traction surfaces.

Boots or shoes having replaceable soles are well known in the prior art and are used in many different applications where it is desired to have multiple different traction surfaces available on a single boot. One such application is a wader used by fishermen. The normal traction surface is felt which works well when walking on a sand or gravel river bottom. However, if the river bottom is rocky, spikes are preferred and the type of spike depends on the size and type of rocks. If the user wants to wear the boots in a boat, a soft rubber surface is desirable, and if the boots are worn while hiking into and out of the river a harder rubber surface with a tread pattern is preferred. However, in the prior art boots of this type the replaceable soles are either difficult to attach and remove or they do not firmly attach to the bottom of the boot.

The subject invention overcomes the shortcomings of the prior art boots by placing a cavity in the sole of the boot and having a sole plate that fills this cavity. A tab located on the toe end of the sole plate fits into a slot located in the peripheral wall of the cavity to hold the toe end of the sole plate in the cavity. A strap attached to the heel end of the sole plate is received by an attachment device located at the back of the boot. The attachment device places the strap in tension to hold the heel end of the sole plate in the cavity.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
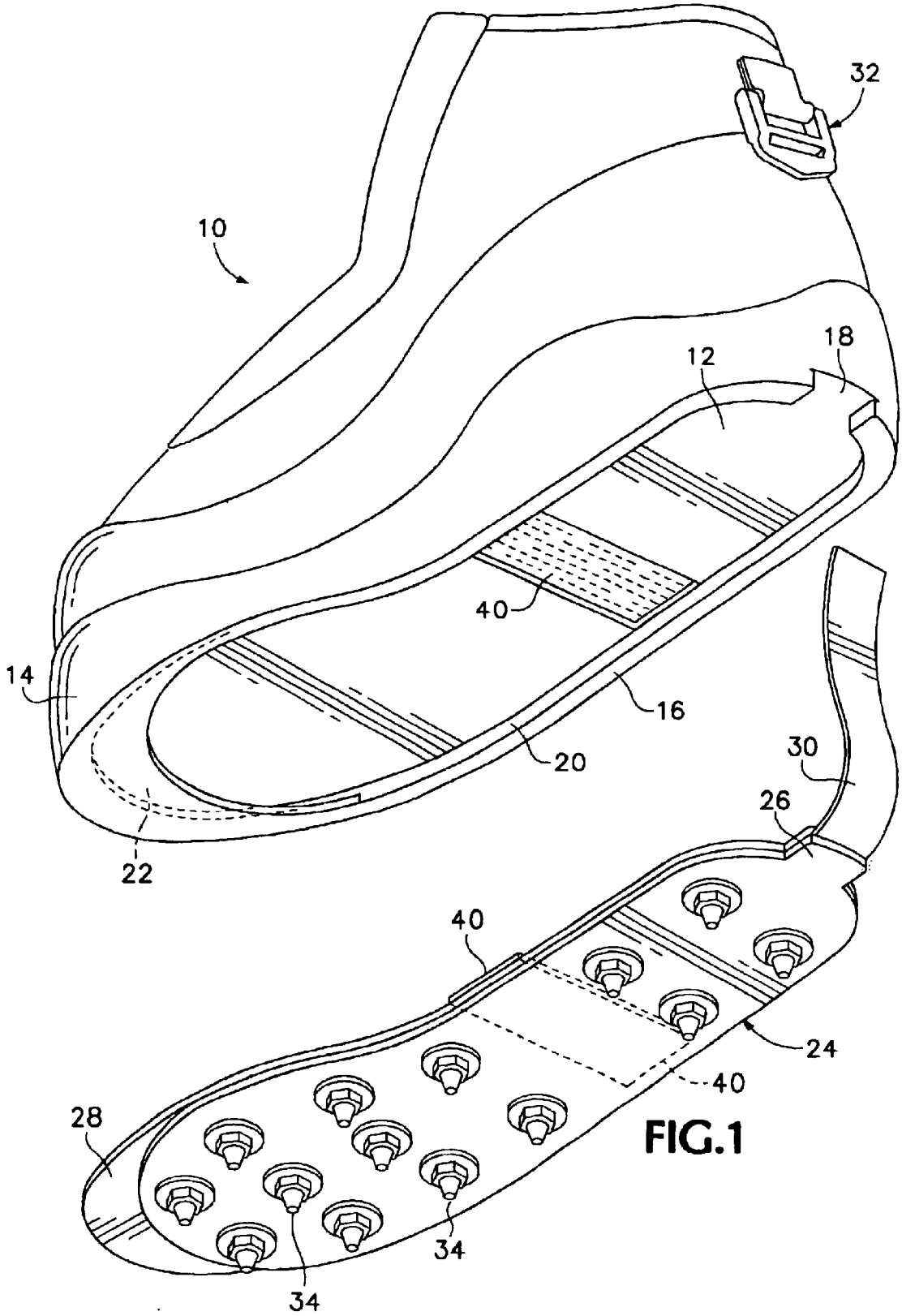
FIG. 1 is an exploded perspective view of a boot embodying the subject invention.

The subject invention is referred to herein as a boot, however, it could be a shoe as well and the word boot is meant to cover both boots and shoes. Referring now to FIG. 1 of the drawings, a boot 10 has an elongate shallow cavity 12 formed in the bottom of its sole 14. The cavity 12 covers the majority of the bottom surface of the sole with only a thin raised lip 16 remaining around the periphery of the sole. The lip 16 is somewhat wider at the toe end of the outer sole, for reasons which will be explained later. The cavity 12 includes a passageway 18 which opens out of the back edge of the heel of the sole. The sidewall 20 of the cavity is normal to the surface of the lip 16. A thin slot 22 is located medially in the sidewall 20 at the toe end of the boot.

A thin sole plate 24 is sized to fill the cavity 12. The sole plate has a tongue 26 located at its heel end which fits into the passageway 18. The sole plate is made from an elastomeric material and preferably has a flexibility that is similar to that of the sole. A thin tab 28, located at the toe end of the sole plate, fits into the slot 22 when the sole plate is inserted into the cavity. The tab is made from plastic material, such as ABS and is far less flexible than the rest of the sole plate. In a preferred embodiment the tab is glued to the sole plate but they could be joined by other means. Located at the heel end of the sole plate, preferably at the extremity of the tongue 26, is a flexible strap 30. An attachment device 32, located at the back end of the boot, receives the strap and pulls it upwardly to place it in tension so that it will hold the heel end of the sole plate in the cavity. The attachment device illustrated is a simple buckle in which the strap 30 is looped over a bar and back over itself and then pulled tight to create the tension, FIG. 2. Other attachment devices, such as a ratchet device or an over-center device can also be used to create this tension. By placing the strap 30 at the back of the tongue 18 all the force created by the tension in the strap is perpendicular to the traction surface so the strap holds the sole plate firmly in place.

The embodiment shown has a piece of interfitting releasable fastener 40 placed on the bottom of the cavity and on the inside of the sole plate roughly midway between the toe and heel ends. 3M DUAL LOCK material works well for this purpose. While this intermediate fastener helps hold the middle part of the sole plate in the cavity, it may or may not be required depending on the softness of the sole plate.

Figure 2:
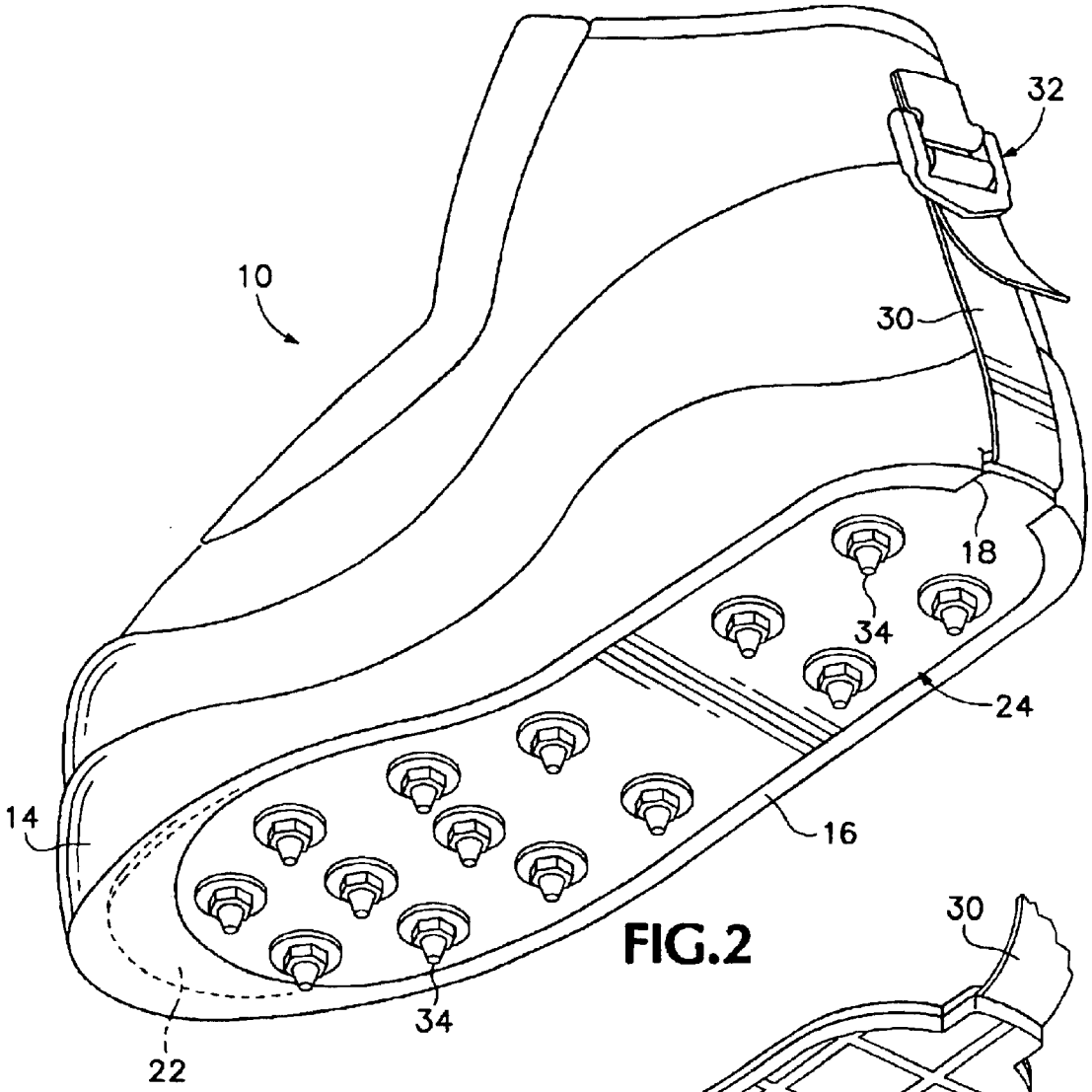
FIG. 2 is a perspective view of the boot of FIG. 1.
Figure 3:
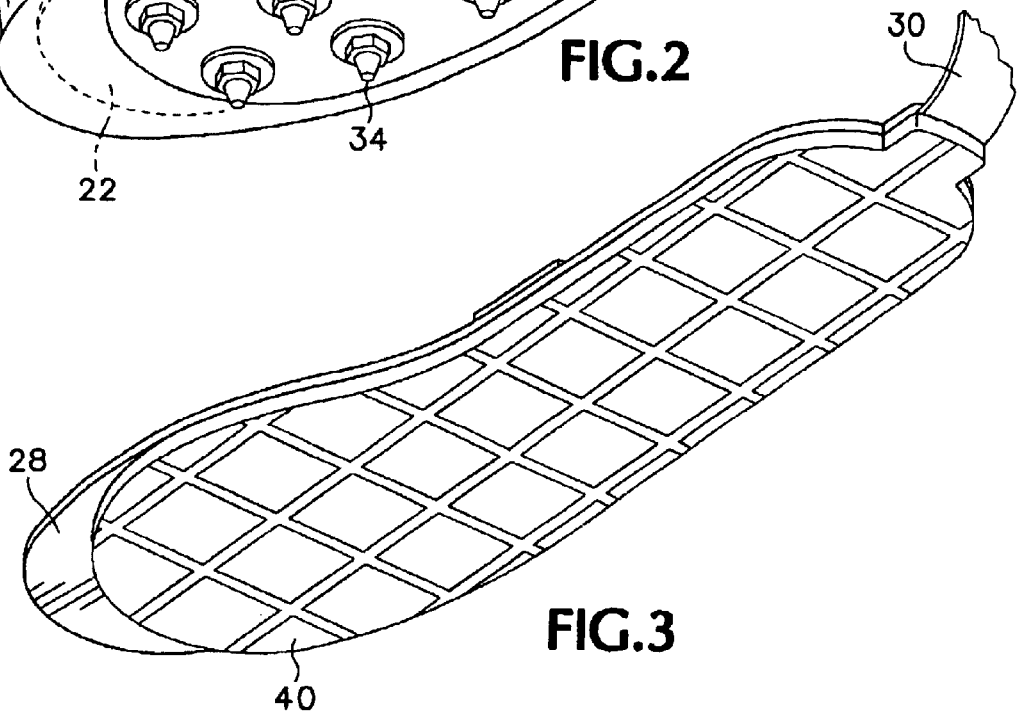
FIGS. 3–6 are alternative sole plates with different types of traction surfaces.
Figure 4:
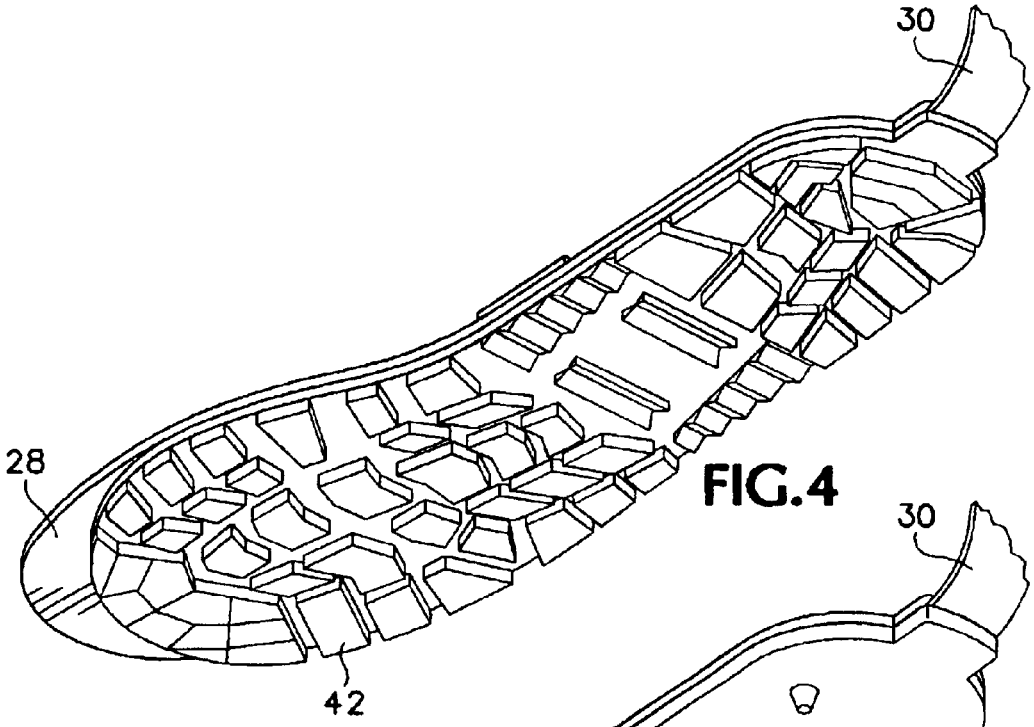
Figure 5:
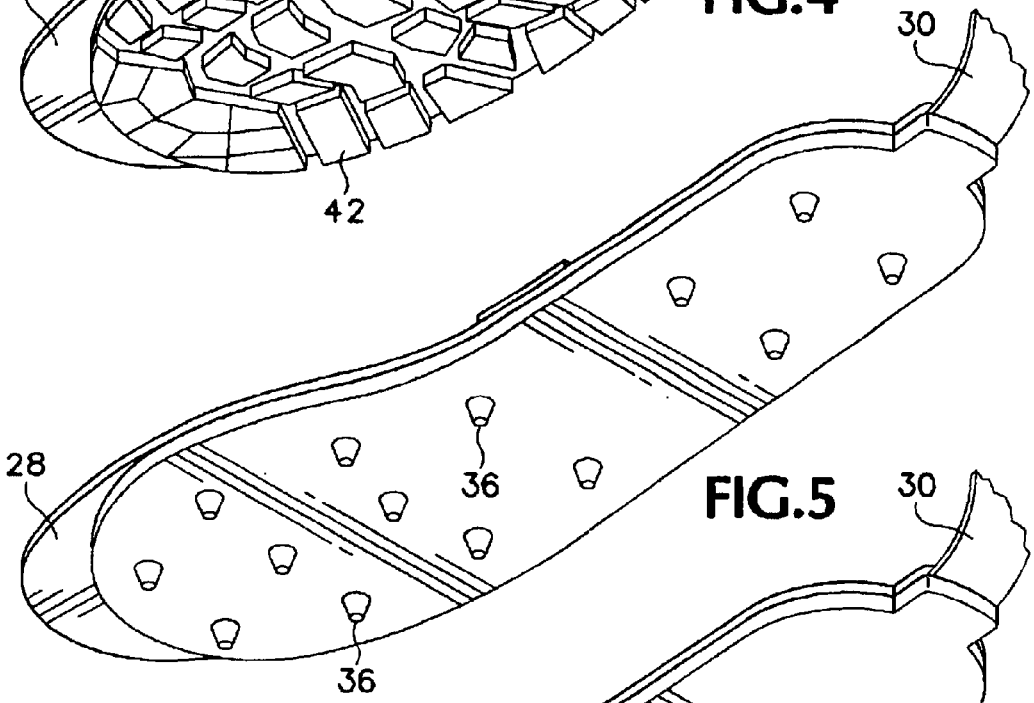
Figure 6:
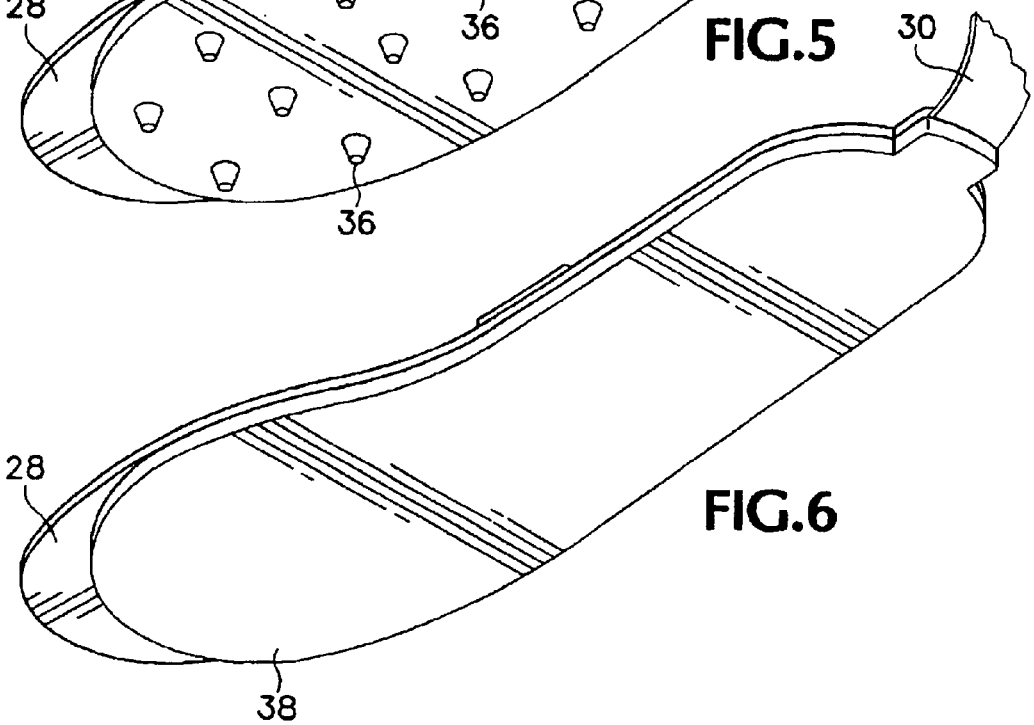

The sole plate shown in FIGS. 1 and 2 has large spikes 34 projecting from its traction surface. Alternatively, it could have smaller spikes 36, as shown in FIG. 5. The traction surface could also be felt 38, FIG. 6, soft rubber 40, FIG. 3, or hard rubber with a tread pattern 42, FIG. 4 depending on the intended use of the boot.

The sole plate is installed quickly and easily by inserting the tab 28 into the slot 22 and placing the sole plate into the cavity 12. The strap 30 is then inserted into the attachment device 32 and tightened to put the strap into tension. If the releasable fastener is used it is engaged by pushing the center of the sole plate toward the boot.

When installed the peripheral walls 20 of the cavity prevent lateral movement of the sole plate relative to the sole. The innerfitting tab 28 in slot 22 prevents vertical movement of the toe portion of the sole plate relative to the sole. Finally, the tension in the strap 30 prevents vertical movement of the sole plate relative to the sole and prevents the sole plate from becoming dislodged from the cavity.

Figure 7:
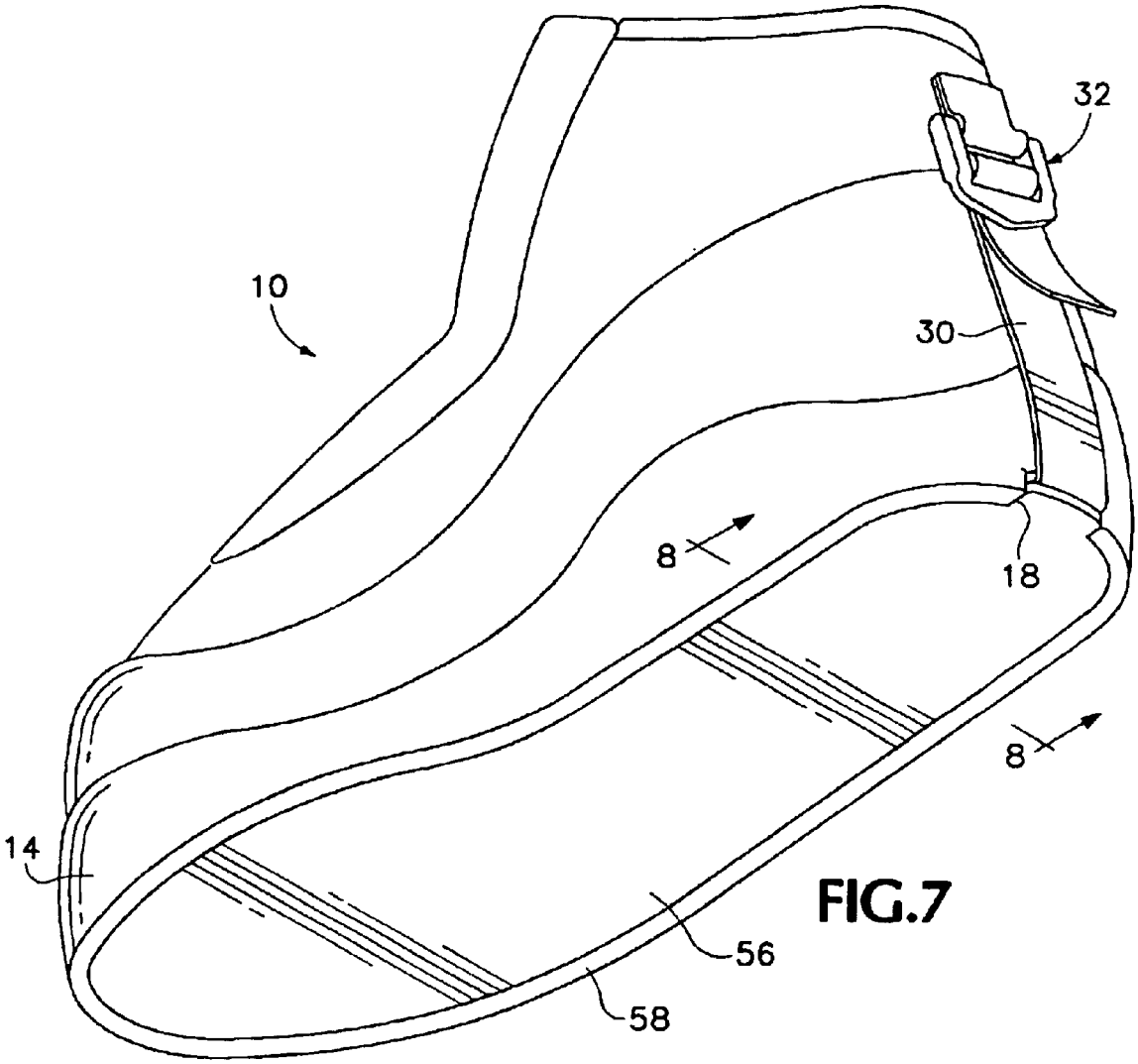
FIG. 7 is a perspective view of a boot which is an alternate embodiment of the invention.
Figure 8:
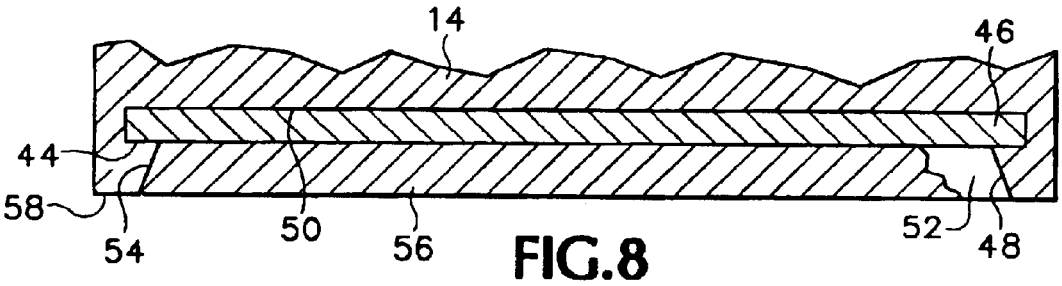
FIG. 8 is a cross-sectional view taken on the line 8—8 of FIG. 7.

In another embodiment of the invention, shown in FIGS. 7 and 8, the slot 44 and the tab 46 extend over the entire sidewall 48. Preferably the tab 46 extends from the rest of the sole plate 56 by a uniform distance which is less than the amount the tab 28 projects. In a preferred embodiment the tab projects approximately 1/16th of an inch from the rest of the sole plate. In addition, the sidewall 48 is angled outwardly as it extends away from the bottom surface 50 of the cavity 52. The side 54 of the sole plate 56 also is angled to conform to the sidewall 48 when the sole plate is inserted into the cavity. Finally, the lip 58 has a uniform width, which is less than the width of the lip 16. The remainder of the boot is the same as it is in the previous embodiment.

With this embodiment the sole plate 56 can be snapped into place in the cavity simply by pushing it inwardly toward the sole. The relatively small width of the tab 46 and the lip 58 allow the lip to flex outwardly to permit this to occur. The angled sidewall 48 also facilitates the installation of the sole plate into the cavity.

To remove the sole plate the strap 30 is removed from the attachment device 32. The strap 30 is then used to pull the sole piece out of the cavity. Again the relatively small width of the tab 46 and the lip 58 allow this to occur without having to apply undue force on the strap.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A boot comprising:

(a) a sole having a toe end, a heel end, and a bottom surface with a thin cavity defined therein, said cavity having a peripheral sidewall;

(b) a sole plate sized to fill said cavity, said sole plate having an outwardly facing traction surface;

(c) a slot defined in said peripheral sidewall proximate said toe end of said sole;

(d) a tab located on said sole plate which fits snugly into said slot when said sole plate is placed into said cavity;

(e) a strap which is attached to said sole plate proximate the heel end of said outer sole; and (f) an attachment device located on the boot which receives said strap and places said strap in tension to hold said sole plate in said cavity at the heel end of said sole.

2. The boot of claim 1 including a piece of interlocking releasable fastener located on said sole plate and said sole intermediate said heel and toe ends to hold a medial portion of said sole plate in said cavity.

3. The boot of claim 1 wherein said cavity includes a passageway which opens out of the heel end of said sole, said sole plate includes a tongue which fits into said passageway and said strap is attached to the extremity of said tongue.

4. The boot of claim 1 wherein said traction surface is felt.

5. The boot of claim 1 wherein said traction surface is soft rubber.

6. The boot of claim 1 wherein said traction surface is elastomeric with a tread pattern defined therein.

7. The boot of claim 1 wherein said traction surface has a plurality of protruding spikes.

8. The boot of claim 1 wherein said attachment device has a quick release mechanism for releasing said strap.

* * * * *